United States Patent [19]

Meisel, Jr.

[11] 4,019,587

[45] Apr. 26, 1977

[54] WORK VEHICLE HAVING VARIABLE CURVATURE BLADE ASSEMBLY

[75] Inventor: Thomas C. Meisel, Jr., Peoria, Ill.

[73] Assignee: Caterpillar Tractor Co., Peoria, Ill.

[22] Filed: May 17, 1976

[21] Appl. No.: 687,054

[52] U.S. Cl. ..... 172/802; 172/806; 37/50

[51] Int. Cl.[2] ..... E02F 3/76

[58] Field of Search ..... 172/801, 802, 803, 804, 172/805, 806, 807, 808, 809, 739, 606; 37/41, 50

[56] References Cited

UNITED STATES PATENTS

| | | | |
|---|---|---|---|
| 1,926,011 | 9/1933 | Soule | 37/44 |
| 2,160,973 | 6/1939 | Litchy | 37/46 |
| 3,039,542 | 6/1962 | Vonville | 172/739 |
| 3,157,099 | 11/1964 | Ulrich | 172/804 |
| 3,653,450 | 4/1972 | Rockwell | 172/806 |
| 3,853,181 | 12/1974 | Yoshizaki | 172/739 |

FOREIGN PATENTS OR APPLICATIONS

| | | | |
|---|---|---|---|
| 47-20503 | 6/1972 | Japan | 172/802 |

*Primary Examiner*—Richard J. Johnson
*Attorney, Agent, or Firm*—Frank L. Hart

[57] ABSTRACT

A work vehicle has a blade assembly formed of upper, middle, and lower generally horizontally extending blade portions that are controllably, pivotally movable for varying the general curvature of the working surface of the blade assembly.

9 Claims, 4 Drawing Figures

10
12
22
13
11
26
27
"A"
16
14
"B"
17
28
15
18
19
21
29

10
26
17
16
21
18
20
33
31
12
22
11
12
30
32
21
18
19
15
14
13

WORK VEHICLE HAVING VARIABLE CURVATURE BLADE ASSEMBLY

BACKGROUND OF THE INVENTION

In the operation of work vehicles having a blade assembly, it is sometimes difficult to move material along in front of the blade. The flow of material in front of the blade is dependent upon the curvature of the blade and the physical properties of the material being moved. Where the material is undesirably wet, it is also difficult to free the blade of material by raising the blade.

Since the physical properties of the material to be worked vary greatly from day to day, it is desirable to provide a blade assembly whose curvature is readily adjustable to a configuration that will most efficiently handle the material to be moved and thereby avoid waste of time, labor, and fuel.

This invention therefore resides in apparatus for controllably varying the configuration of the working surface of a blade assembly of a work vehicle.

DETAILED DESCRIPTION OF THE INVENTION

Figure 1:
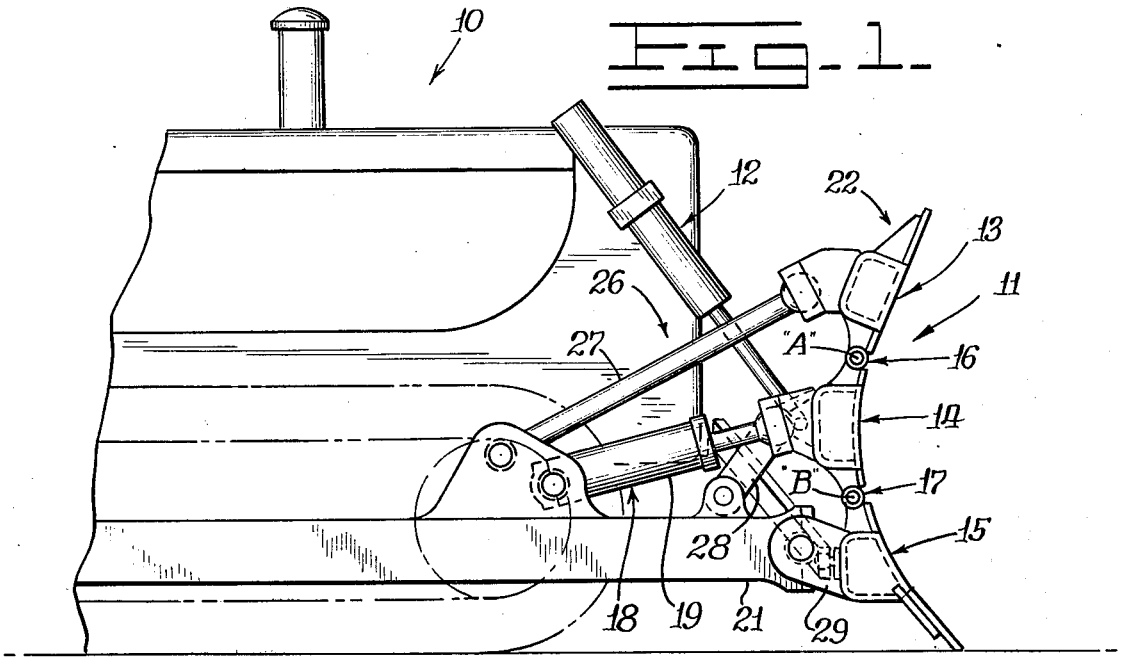
FIG. 1 is a diagrammatic side view of a portion of a work vehicle having the apparatus of this invention.
Figure 2:
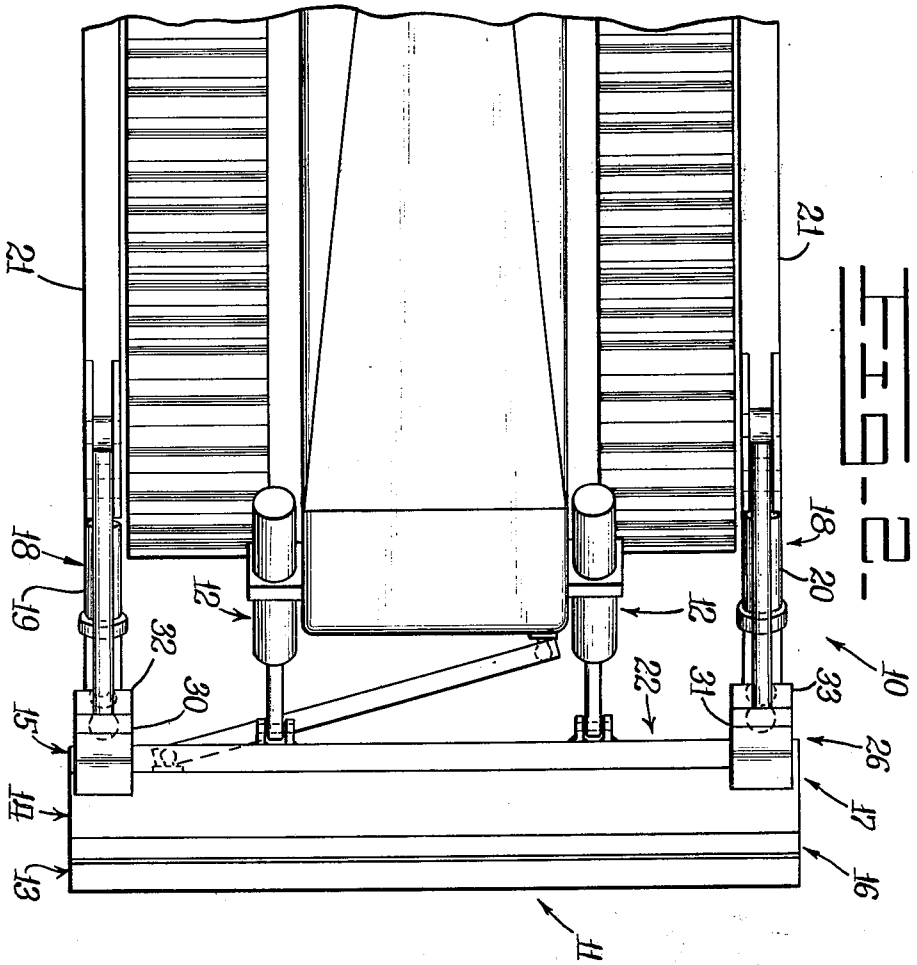
FIG. 2 is a diagrammatic top view of a portion of the vehicle of FIG. 1.
Figure 4:
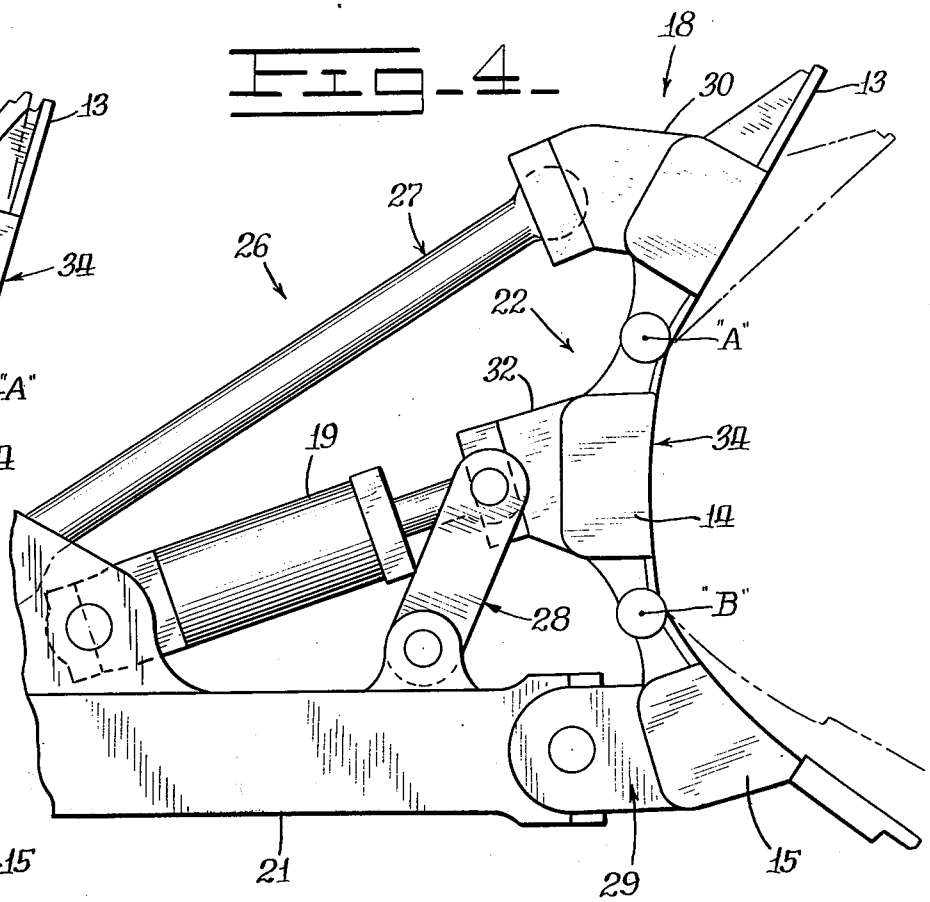
FIGS. 3 and 4 are diagrammatic side views of the blade assembly of the vehicle of FIG. 1 with blade portions of said blade assembly being controllably located at various positions.

Referring to FIGS. 1 and 2, a work vehicle 10, for example a crawler type tractor, has a blade assembly 11 and means 12 connected to the blade assembly 11 for controllably raising and lowering the blade assembly 11.

The blade assembly 11 of this invention is formed of at least upper, middle, and lower blade portions 13,14,15, as better seen in FIG. 1. The blade portions 13,14,15 are elongated and extend generally horizontally across the front of the vehicle 10.

First and second means 16,17 are associated with the blade assembly 11 for pivotally connecting the blade portions 13,14,15 one to the other for pivotal movement of the upper and lower blade portions 13,15 relative to the middle blade portion 14 and about first and second generally horizontally extending axes A, B.

The first and second pivot means 16,17 can be pins extending through openings formed through adjacent blade portions or other pivot structure as is known in the art.

Third means 18 is provided for controllably pivoting the blade portions 13,14,15 about the first and second axes A, B. The third means 18 can comprise one or more fluid cylinders 19,20. In the preferred embodiment shown in FIGS. 1–4, the third means 18 comprises two cylinders 19,20 each connected at one end to a frame 21 of the vehicle 10 and at the other end to a rear surface 22 of one of the blade portions 13,14, or 15 at spaced locations one from the other. The third means 18 is preferably connected to the middle blade portion 14. By this construction, smoothness of blade movement is increased.

It should be understood, however, that the third means can comprise one or more fluid cylinders connected to each or a portion of the blade portions 13,14,15. However, in the preferred embodiment, the third means 18 comprises fluid cylinders 19,20, such as hydraulic cylinders, connected to the middle blade portion 14 and linkage means 26, as better shown in FIGS. 3 and 4, for controllably, pivotally moving the remaining blade portions 13,15 in response to movement of blade portion 14 by the fluid cylinders 19,20.

The linkage means 26 has a first link 27 pivotally connecting the upper blade portion 13 and the frame 21 and a second link 28 pivotally connecting the middle blade portion 14 and the frame 21 and a third link 29 pivotally connecting the lower blade portion 15 to the frame 21. One end of one or all of the links 27,28,29 can be fixedly connected to an associated element of the vehicle 10.

In order to increase the smoothness of movement of the blade portions 13,14,15, the fluid cylinder or cylinders 19,20 and the first link 27 are shown connected to the respective middle blade portion 14 and upper blade portion 13 by ball joints 30–33. The lower blade portion 15 is shown connected by a ball trunnion joint. Other pivot structures as known in the art can be used.

Figure 3:
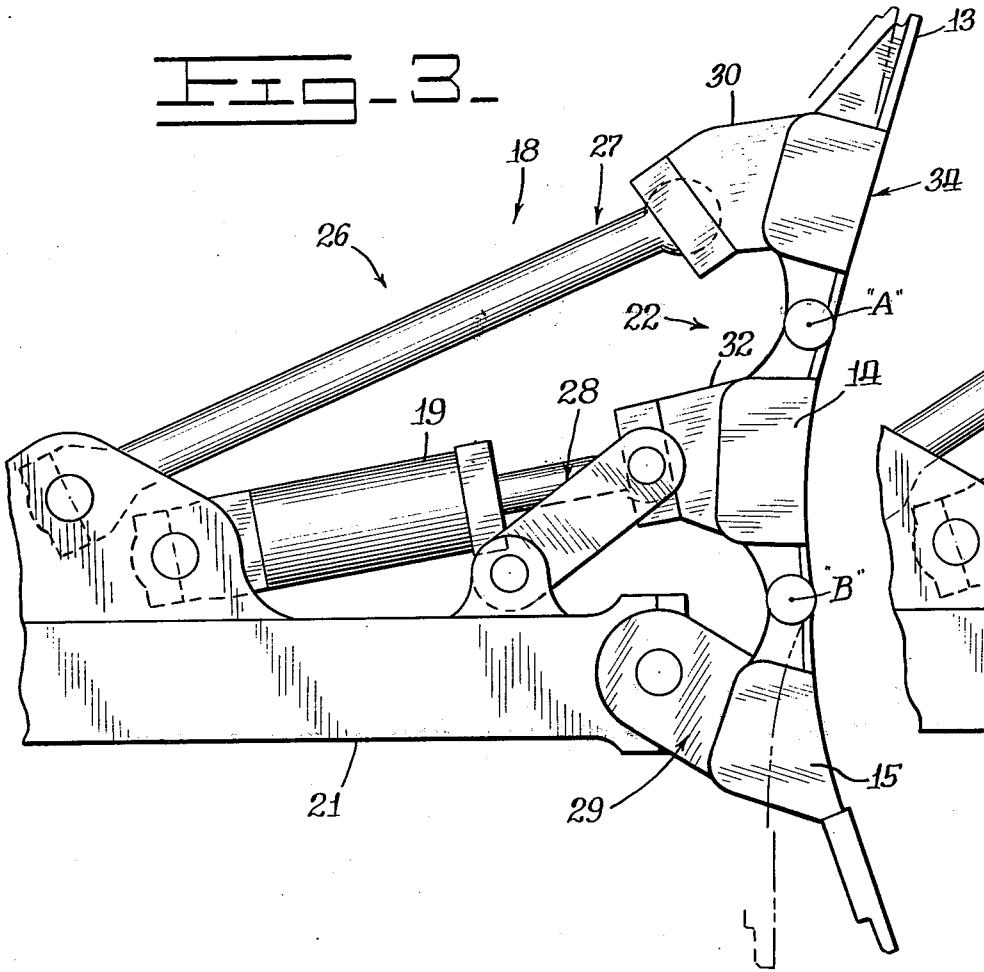

The blade portions 13,14,15 are movable in response to moving the pivotal connection of blade portion 14, for example, by the cylinders 19,20 in a direction sufficient to impart a horizontally directed movement component to the connection. In response to movement by the cylinders 19,20, the blade portions 13,14,15 are controllably moved between a first position, shown by broken lines in FIG. 4, at which the working surface 34 of the blade assembly 11 defines a curve of preselected configuration and a second position, shown by broken lines in FIG. 3, at which the working surface 34 is more planar and preferably generally approximates a plane. An operator can therefore adjust the working surface 34 of the blade assembly 11 to a configuration which most efficiently moves the material being pushed thereby. For example, when pushing sticky mud, a blade position as shown in FIG. 3 is considered more efficient than the position of FIG. 4. Sticking mud, for example, can also be readily cleaned from the blade by the sudden deceleration of the blade portions at reaching their pivotal limits.

Other aspects, objects, and advantages of this invention can be obtained from a study of the disclosure, the drawings, and the appended claims.

What is claimed is:

1. In a work vehicle having a blade assembly and means connected to the blade assembly for controllably raising and lowering said blade assembly, the improvement comprising:

said blade assembly being formed of at least upper, middle, and lower generally horizontally extending blade portions;

first and second means for pivotally connecting the blade portions one to another for pivotal movement of the upper and lower blade portions relative to the middle blade portion and about first and second generally horizontally extending axes; and third means for controllably pivoting the blade portions about said first and second axes, said third means including at least one fluid cylinder for controllably moving the pivotal connection of at least one of the blade portions, said fluid cylinder being at a location sufficient for providing said movement with a horizontal direction component.

2. Apparatus, as set forth in claim 1, wherein the blade portions are controllably movable between a first position at which the blade assembly defines a curved blade surface of a preselected configuration and a second position at which the blade assembly defines a blade surface that is of a more planar configuration relative to said first position.

3. Apparatus, as set forth in claim 1, wherein the fluid cylinder is connected to the middle blade portion.

4. Apparatus, as set forth in claim 1, wherein the fluid cylinder is connected at one end to the vehicle and at the other end to a rear surface of the middle blade portion.

5. Apparatus, as set forth in claim 1, wherein the third means comprises:

first and second fluid cylinders each connected at one end to the vehicle and at the other end to a rear surface of the middle blade portion at spaced locations one from the other.

6. Apparatus, as set forth in claim 1, including:

a ball joint connecting the middle blade portion to the fluid cylinder.

7. Apparatus, as set forth in claim 1, including:

linkage means for controllably, pivotally moving the remaining blade portions in response to movement of said one blade portion by said fluid cylinder.

8. Apparatus, as set forth in claim 7, wherein the vehicle has a frame and wherein the linkage means includes:

a first link pivotally connecting the upper blade portion and the frame;

a second link pivotally connecting the middle blade portion and the frame; and a third link pivotally connecting the lower blade portion and the frame.

9. Apparatus, as set forth in claim 8, including:

a ball joint connecting the first link to the upper blade portion.

* * * * *